US007999692B2

(12) United States Patent
Sendrowski, Jr.

(10) Patent No.: US 7,999,692 B2
(45) Date of Patent: Aug. 16, 2011

(54) NON-ADDRESSABLE DUAL NOTIFICATION APPLIANCE

(75) Inventor: John J. Sendrowski, Jr., Troy, NH (US)

(73) Assignee: SimplexGrinnell LP, Westminster, MA (US)

( * ) Notice: Subject to any disclaimer, the term of this patent is extended or adjusted under 35 U.S.C. 154(b) by 528 days.

(21) Appl. No.: 11/906,827

(22) Filed: Oct. 4, 2007

(65) Prior Publication Data

US 2009/0091466 A1 Apr. 9, 2009

(51) Int. Cl.
*G08B 3/00* (2006.01)
*G08B 5/00* (2006.01)
*G08B 7/00* (2006.01)

(52) U.S. Cl. ..... 340/691.1; 340/691.6; 340/691.8

(58) Field of Classification Search ..... 340/691.1
See application file for complete search history.

(56) References Cited

U.S. PATENT DOCUMENTS

| | | | | |
|---|---|---|---|---|
| 6,281,789 | B1 * | 8/2001 | Furtado et al. | 340/506 |
| 2007/0035407 | A1 * | 2/2007 | Capowski et al. | 340/679 |
| 2007/0109114 | A1 * | 5/2007 | Farley et al. | 340/506 |
| 2007/0115111 | A1 * | 5/2007 | Girouard | 340/507 |

* cited by examiner

*Primary Examiner* — Travis Hunnings
(74) *Attorney, Agent, or Firm* — Keohane & D'Alessandro PLLC

(57) ABSTRACT

The present invention provides a non-addressable notification appliance having multiple (e.g., dual) visual alarms such as strobes for notifying individuals of different types of detected events. For example, the notification appliance of the present invention could have a first strobe for indicating a fire, and a second strobe for providing mass notification of a different emergency such as a terrorist threat or attack. In one embodiment, the visual alarms could be colored differently from one another (e.g., clear and amber). In a typical embodiment, the dual notification appliance could be one of many non-addressable dual notification appliances utilized in a single alarm system that are controlled by a system controller.

19 Claims, 5 Drawing Sheets

NON-ADDRESSABLE DUAL NOTIFICATION APPLIANCE

FIELD OF THE INVENTION

The present invention generally relates to alarm systems. Specifically, the present invention relates to a non-addressable dual notification (e.g., strobe) appliance.

BACKGROUND OF THE INVENTION

Typical building fire alarm systems include a number of fire detectors positioned throughout a building. Signals from those detectors are monitored by a system controller, which, upon sensing an alarm condition, sounds audible alarms throughout the building. Flashing light strobes may also be positioned throughout the building to provide a visual alarm indication. In a system sold by Simplex Time Recorder Company disclosed in U.S. Pat. No. 4,796,025 (hereinafter the '025 patent), the contents of which are incorporated herein by reference, fire detectors are monitored and controlled through common power lines which also serve as communication links. Communications are by means of encoded pulses of voltage drops in power. Notification appliance circuits (NACs) may also be coupled to those communication links through a NAC controller but additional power is applied to the NACs due to the higher power requirements of NACs.

A number of notification appliances comprising audible alarms and strobes generally referred to as notification devices, are typically connected across common power lines on a notification circuit, either directly coupled to the central panel or through a NAC controller on a detector circuit. A first polarity DC voltage may be applied across the notification circuit in a supervisory mode of operation. In this supervisory mode, rectifiers at the notification appliances are reverse biased so that the alarms are not energized, but current flows through the power lines at the notification circuit to an end-of-line resistor and back, allowing the condition of those lines to be monitored. With an alarm condition, the polarity of the voltage applied across the power lines is reversed to energize all notification appliances on the notification circuit.

U.S. Pat. No. 5,559,492 issued to Stewart el al. (hereinafter the '492 Stewart patent), the contents of which are incorporated herein by reference, further discloses that the visual alarms, or strobes, may be synchronized to fire simultaneously with power interruptions, also referred to as synchronization pulses, in the power lines. Additional timing lines for synchronizing the strobes are not required because the synchronizing signals are applied through the existing common power lines. Still yet, U.S. Pat. No. 6,281,789 issued to Furtado el al. (hereinafter the '789 Furtado patent), the contents of which are incorporated herein by reference, discloses an alarm system that includes multiple notification appliances for signaling an alarm condition. The system controller intelligently controls the notification appliances including notification devices such as an audible or visual alarm through multi-bit digital messages sent over common communication lines.

SUMMARY OF THE INVENTION

In general, the present invention overcomes deficiencies in existing alarm systems by providing a non-addressable dual notification appliance. Specifically, the present invention provides a notification appliance having multiple (e.g., dual) visual alarms such as strobes for notifying individuals of different types of detected events. For example, the notification appliance of the present invention could have a first strobe for indicating a fire, and a second strobe for providing mass notification of a different emergency such as a terrorist threat or attack. In one embodiment, the visual alarms could be colored differently from one another (e.g., clear and amber). In a typical embodiment, the dual notification appliance could be one of many non-addressable dual notification appliances utilized in a single alarm system that are controlled by a system controller. The notification appliances of the present invention provide many advantages over existing devices. For example, the appliances of the present invention will use the wiring of existing appliances. This allows the appliances of the present invention herein to be swapped in place of existing appliances using the same power source, and without modifying the existing wiring. This is the case even though previous device included only a single strobe.

A first aspect of the present invention provides a non-addressable dual notification appliance, comprising: at least two notification indicators; and a controller which receives a control signal from an external source, and which, responsive to a first received control signal having a first pattern, activates a first of the at least two notification indicators, and further which, responsive to a second received, control signal, activates a second of the at least two notification indicators.

A second aspect of the present invention provides an alarm system, comprising: a plurality of non-addressable notification appliances, each non-addressable notification appliance including: at least two notification indicators, and a microcontroller which receives a control signal from a system controller, and which, responsive to a first received control signal having a first pattern, activates a first of the at least two notification indicators, and further which, responsive to a second received, control signal, activates a second of the at least two notification indicators.

A third aspect of the present invention provides an alarm method, comprising: receiving a control message in a non-addressable notification appliance corresponding to a detected event; and activating one a plurality of visual notification indicators based on a type of the detected event to provide visual notification of the detected event.

Therefore, the present invention provides a dual notification appliance for use in an alarm system.

BRIEF DESCRIPTION OF THE DRAWINGS

These and other features of this invention will be more readily understood from the following detailed description of the various aspects of the invention taken in conjunction with the accompanying drawings in which.

Figure 1:
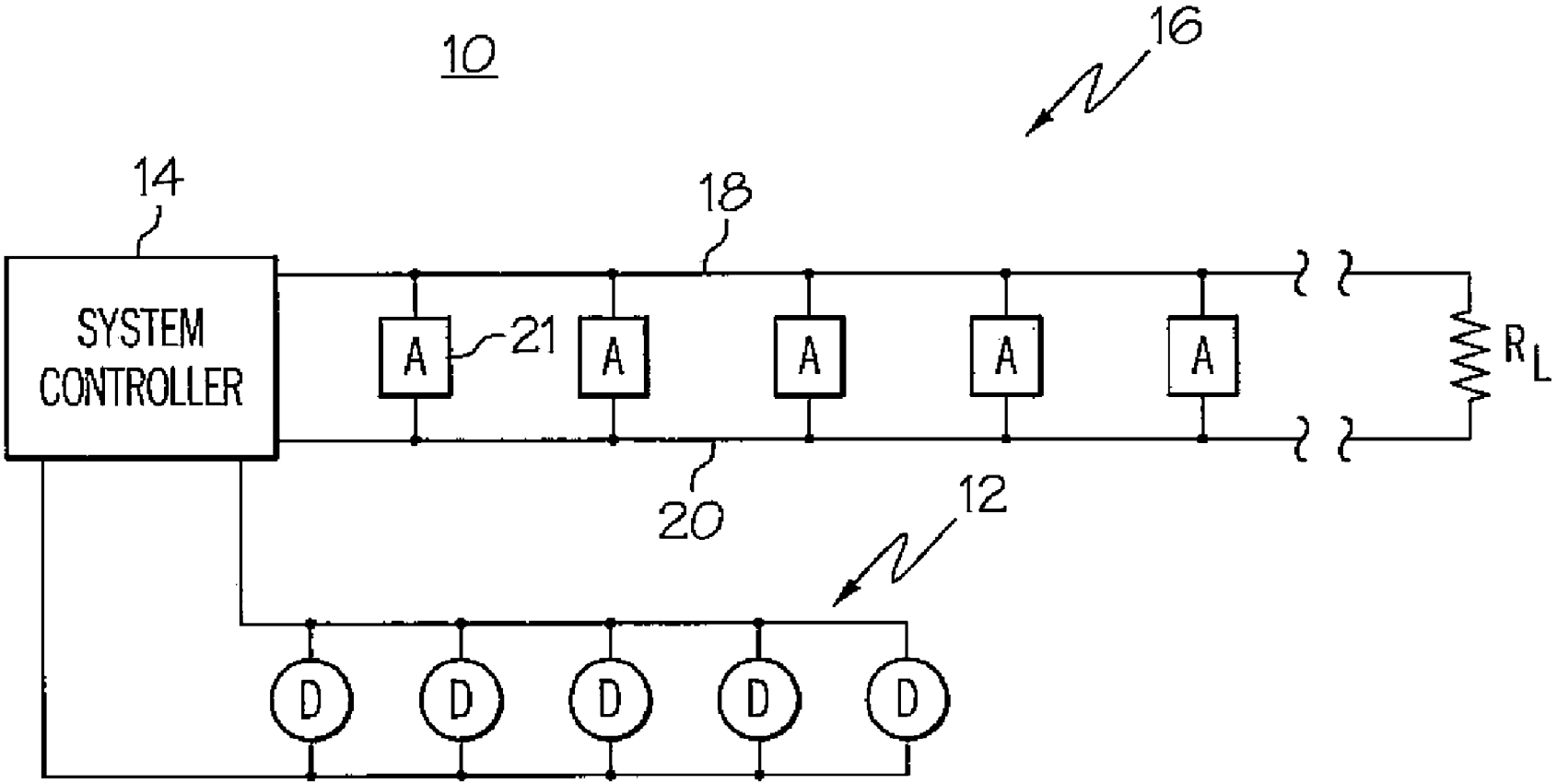
FIG. 1 illustrates an alarm system according to the present invention.

The drawings are not necessarily to scale. The drawings are merely schematic representations, not intended to portray specific parameters of the invention. The drawings are intended to depict only typical embodiments of the invention, and therefore should not be considered as limiting the scope of the invention. In the drawings, like numbering represents like elements.

DETAILED DESCRIPTION OF THE DRAWINGS

As indicated above, the present invention overcomes deficiencies in existing alarm systems by providing a non-addressable dual notification appliance. Specifically, the present invention provides a notification appliance having multiple (e.g., dual) visual alarms such as strobes for notifying individuals of different types of detected events. For example, the notification appliance of the present invention could have a first strobe for indicating a fire, and a second strobe for providing mass notification of a different emergency such as a terrorist threat or attack. In one embodiment, the visual alarms could be colored differently from one another (e.g., clear and amber). In a typical embodiment, the dual notification appliance could be one of many non-addressable dual notification appliances utilized in a single alarm system that are controlled by a system controller. In addition, one or more of the dual notification appliances discussed herein are typically a component of an alarm system as provided in a physical structure such as building. The notification appliances of the present invention provide many advantages over existing devices. For example, the appliances of the present invention will use the wiring of existing appliances. This allows the appliances of the present invention herein to be swapped in place of existing appliances using the same power source, and without modifying the existing wiring. This is the case even though previous device included only a single strobe An alarm system 10 constructed according to the principles of the present invention is illustrated in FIG. 1. As in a conventional alarm system, the system includes one or more detector networks 12 having individual alarm condition detectors D which are monitored by a system controller 14. When an alarm condition is sensed, the system controller 14 signals the alarm to the appropriate devices through at least one network 16 of non-addressable alarm notification appliances A (hereinafter referred to as notification appliances 21). It should be understood, however, that an event could be registered through the manual activation of alarm system 10 by one or more individuals. This allows for even-type-specific visual and/or audible alarms to be used even though detectors may not have yet detected any such conditions. Each device, also called a notification appliance 21, typically includes multiple notification devices, for example, dual visual alarms (strobes), an audible alarm (horn, speaker, etc.), or a combination thereof (A/V device).

As shown, all of the notification appliances can be coupled across a pair of power lines 18 and 20 that advantageously also carry command messages from the system controller 14 to the notification appliances 21. In a supervisory mode of operation, a first polarity DC voltage is applied across the notification circuit 16. In this mode, rectifiers at the notification appliances are reverse biased so that the audible and visual alarms are not energized, but current flows through the power lines 18, 20 to an end-of-line resistor R.sub.L and back, allowing the condition of those lines to be monitored.

With an alarm condition, also referred to as active mode, the polarity of the voltage applied across the power lines 18, 20 is reversed (or forward biased) to energize all notification appliances 21 on the notification circuit 16. In a preferred embodiment of the present invention, the first polarity DC is −24 VDC and the forward biased voltage is 24 VDC, although other voltages can be used in accordance with the present invention.

Figure 2:
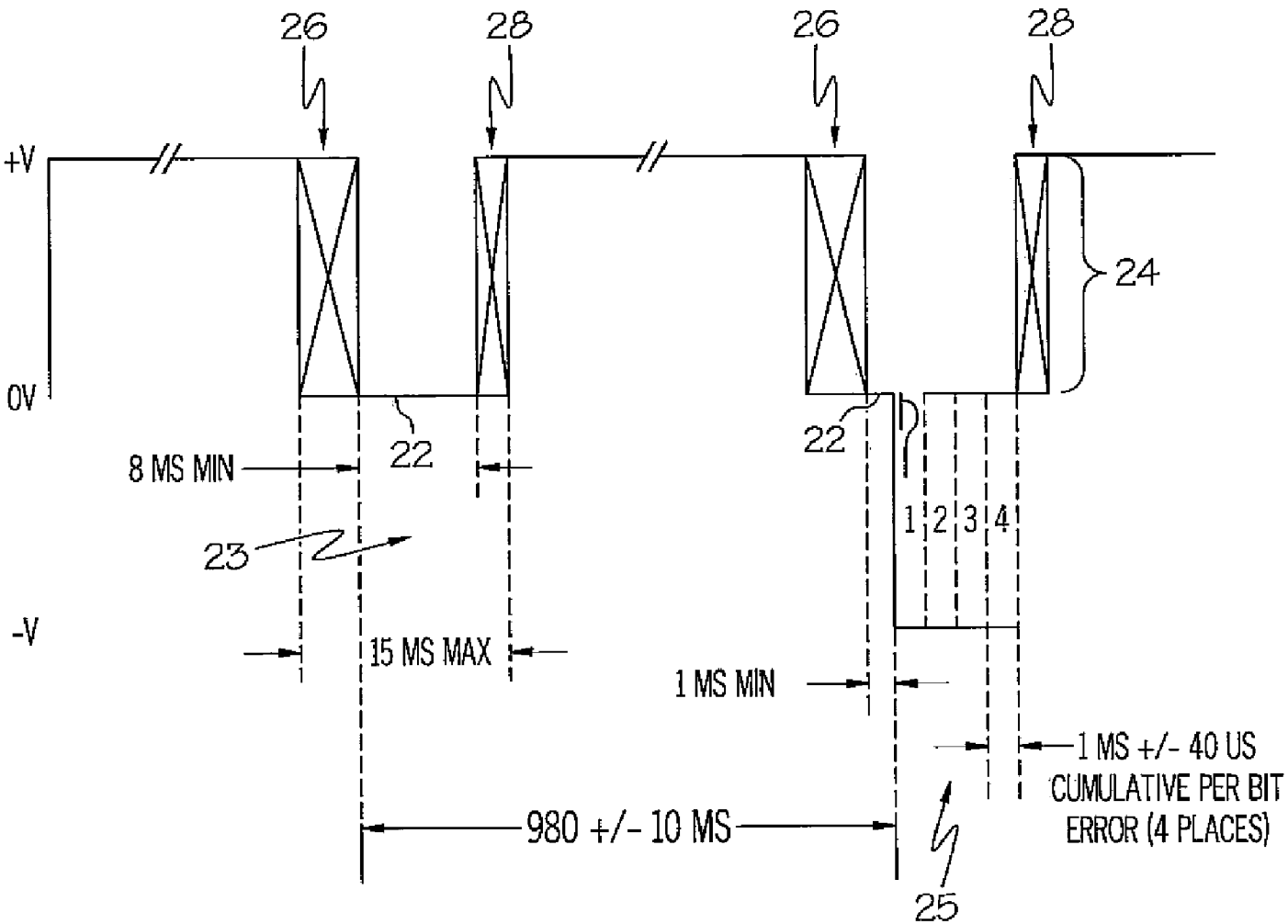
FIG. 2 illustrates exemplary control messages passed between a system controller and a notification appliance during an alarm condition.

FIG. 2 illustrates two control messages 23, 25 issued from the system controller 14 (FIG. 1) to the notification appliances 21 (FIG. 1) during an alarm condition. Each control message 23, 25 includes a synchronization signal 22 which actuates the visual alarms on the notification circuit 16 (FIG. 1). Signal 22 is a "drop-out" or interruption in power to the notification appliances 21 (FIG. 1) wherein the line voltage drops to zero. Synchronization signal 22 is preceded by a relay operate and bounce 26 and followed by a relay release and bounce 28 as understood in the art.

Control message 25 includes a command signal 24 embedded within synchronization signal 22. In a preferred embodiment, command signal 24 includes a series of negative voltage pulses or data pulses extending from zero voltage during the synchronization signal 22. Each notification appliance 21 includes decoding circuitry 38 and a microcontroller 42 (seen in FIGS. 3 and 4), with programmed instructions, which controls the audible alarm according to the command signal 24 received.

In a preferred embodiment of the present invention, command signal 24 includes multiple (e.g., four) bits. The first bit is defined by a negative voltage pulse extending approximately to the reverse polarity value used during the supervisory mode. The first bit is followed by a predetermined number of bits that define a predetermined code that specifies a desired operation. Preferably, three bits follow the first bit. A data 1 bit defines a reverse polarity voltage amplitude, and a data 0 is signaled with a zero voltage amplitude. Each bit is further defined by a predetermined time duration. Preferably, each bit is transmitted for 1 ms+/−40 us. In an alternative embodiment of the present invention, command signal 24 comprises a modulated carrier signal. It should be understood that multiple different types of control messages 25 could be used under the present invention. For example, different control messages could be used to indicate different types of emergencies so that the appropriate visual alarms (strobes) will be activated/deactivated. As will be further described below in conjunction with FIG. 5, the present invention utilizes two different data signals (superimposed on voltage) to control which strobe will be activated/deactivated.

Figure 3:
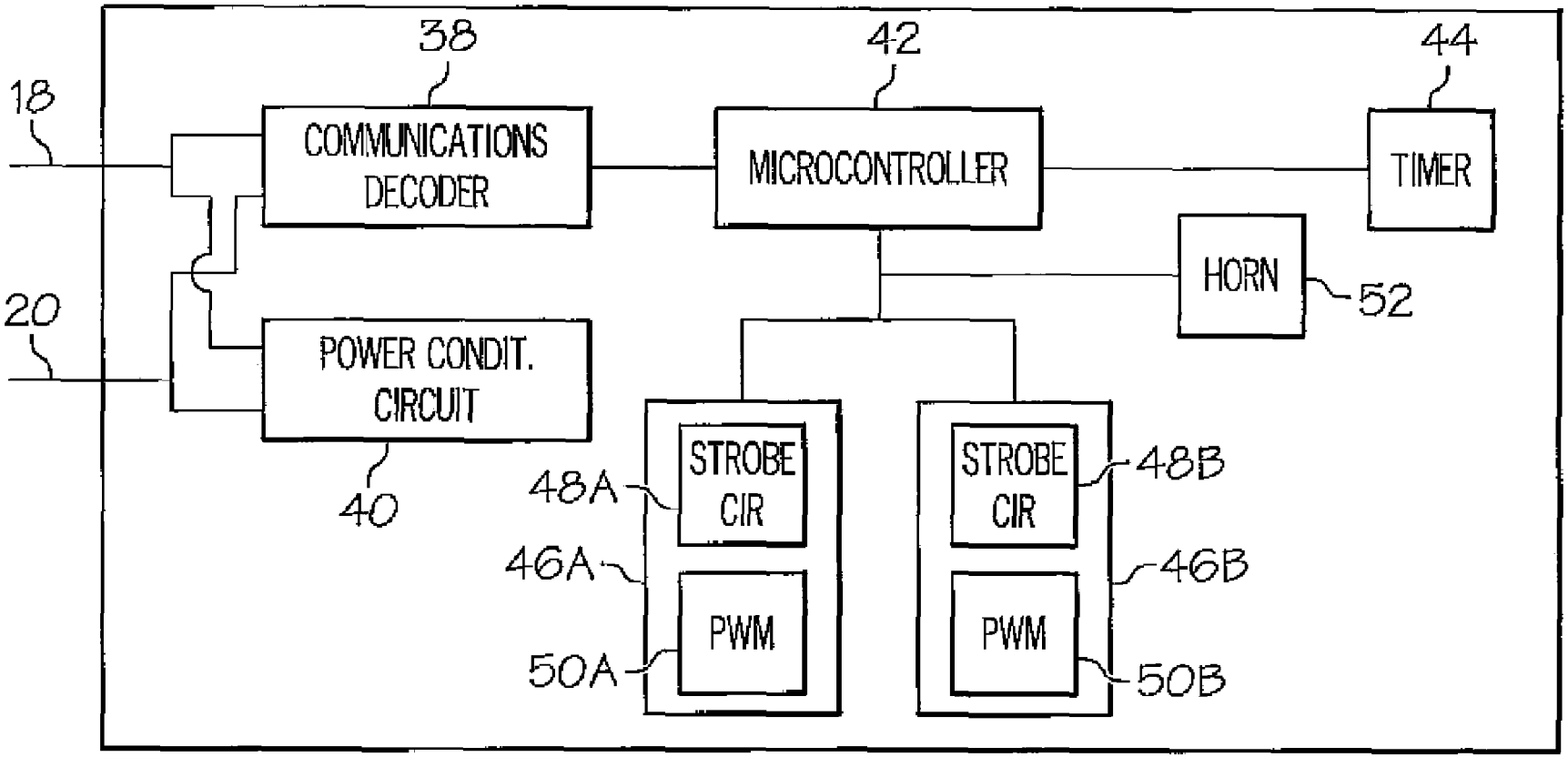
FIG. 3 illustrates, in block diagram, an exemplary notification appliance.
Figure 4:
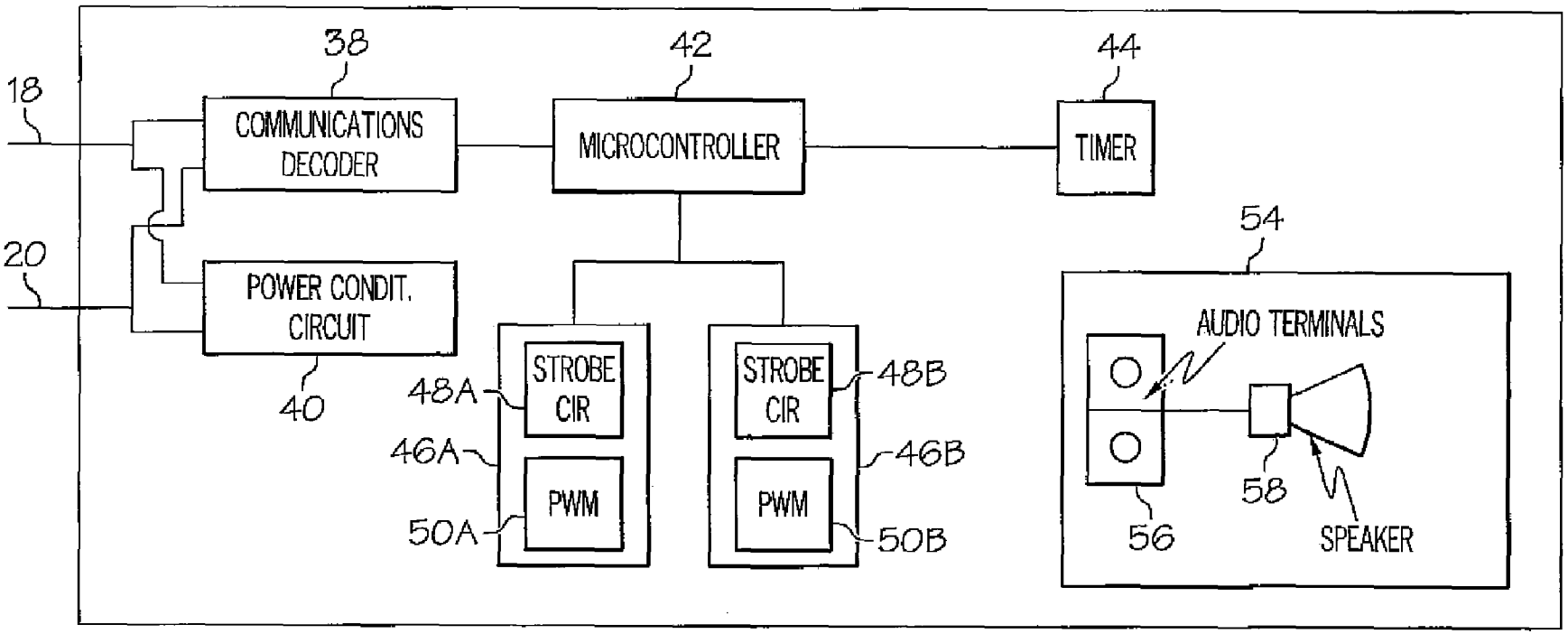
FIG. 4 illustrates, in block diagram, another exemplary notification appliance.

In any event, as shown in FIG. 3, power lines 18 and 20 connect to the notification appliance 21 (FIG. 1), each power line connecting to a communications decoder 38 and a power conditioning unit 40. As understood in the art, the power conditioning unit 40 is used to maintain a constant power flow to the notification appliance 21. The communications decoder 38 is provided to interpret or decode the command messages received from the system controller 14 (FIG. 1). Communicating with the decoder 38 is microcontroller 42 which controls the visible alarms 46A-B, such as a strobe, and the audible alarm 52. Audible alarm 52 can include any enunciator device such as a bell, chime, horn, or whistle. An internal timer 44 connected to microcontroller 42 is used to control the actuation of the visual and/or audible alarm of a respective notification appliance. Alternatively, timer 44 can be positioned within microcontroller 42. In addition, (in lieu of or in combination with horn 52), audible alarm 54 having audio terminals 56 and a speaker 58 can be provided as shown in FIG. 4. Speaker 58 would allow audible instructions to be provided in response to detection of an event.

In any event, the timer 44 of each notification appliance 21 is typically resynchronized by command signal 24 such that the audible alarms 52 are synchronized during alarm conditions. One method of resynchronizing the timers 44 is by resetting the same. As further shown, visual alarms 46A-B (collocated within notification appliance 21) includes strobe circuits 48A-B, which include a charging circuit and a firing circuit similar to those disclosed in the '492 Stewart patent. A pulse width modulator (PWM) 50A-B is provided in alarms 46A-B to control the charging circuit. Microcontroller 42 turns the power to the PWMs 50A-B on/off at the beginning/end of a strobe sequence.

Figure 5:
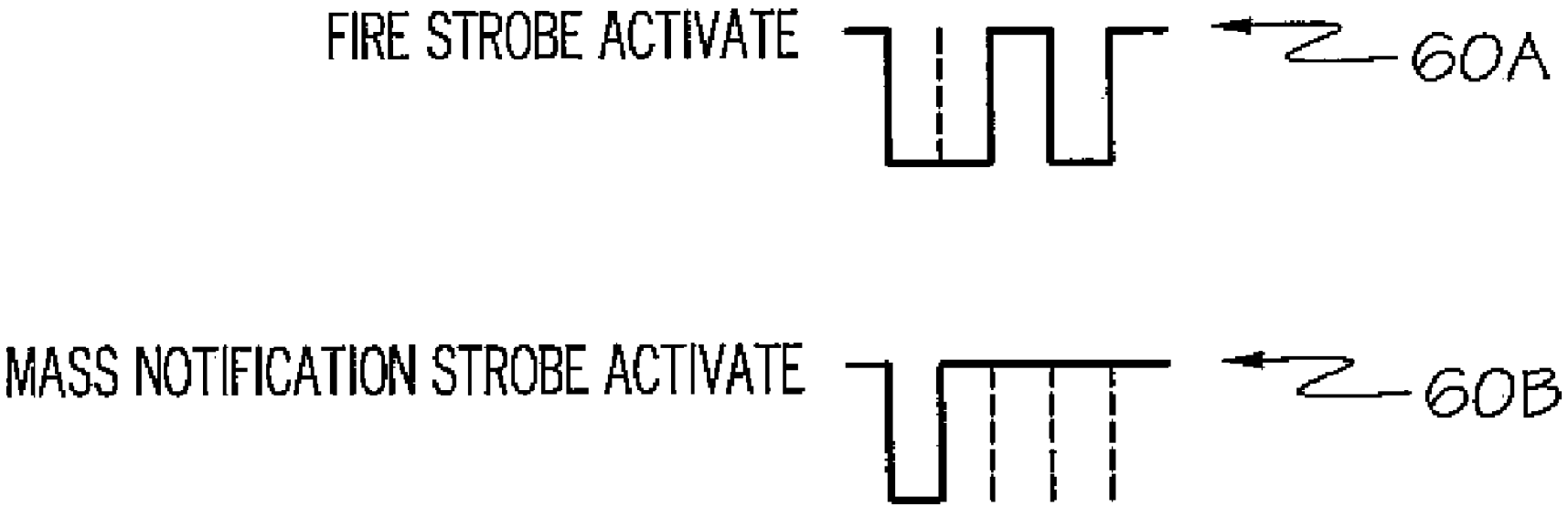
FIG. 5 illustrates two illustrative data signals for activating/deactivating the strobes of the present invention.

In a typical embodiment, communications decoder 38 interprets the command/control messages received from system controller 14 of FIG. 1. Based on the type of event determined to exist, a message will be sent to microcontroller, which will activate a specific/corresponding visual alarm 46A-B. For example, if the event is a fire, a certain visual alarm (e.g., 46A) could be activated. If the event is of a different type (e.g., a mass notification), a different visual alarm (e.g., 46B) could be activated. An example of two different data signals that could be sent to result in such activations is shown in FIG. 5. As depicted, when one strobe (e.g., the fire strobe) is desired to be activated, signal 60A could be sent. Conversely, when the other strobe (e.g., the mass notification strobe) is desired to be activated/deactivated, signal 60B could be sent. In any event, under the present invention, visual alarms 46A-B will have different colors so that viewers could readily identify their difference.

While this invention has been particularly shown and described with references to preferred embodiments thereof, it will be understood by those skilled in the art that various changes in form and details may be made therein without departing from the spirit and scope of the invention as defined by the appended claims.

What is claimed:

1. A non-addressable dual notification appliance, comprising:

at least two visual notification indicators;

microcontroller and communications decoder configured to receive a control signal from a system controller, and which, responsive to a first received control signal having a first pattern, activates a first of the at least two visual notification indicators, and further which, responsive to a second received control signal having a second pattern distinct from the first pattern, activates a second of the at least two visual notification indicators; and wherein the microcontroller and communications decoder are housed within a same structural unit of the non-addressable dual notification appliance comprising the at least two visual notification indicators.

2. The non-addressable dual notification appliance of claim 1, wherein each of the at least two visual notification indicators provides a visual indication of a distinct detected event.

3. The non-addressable dual notification appliance of claim 1, wherein the at least two visual notification indicators are strobes.

4. The non-addressable dual notification appliance of claim 3, further comprising an audible notification device that is activated simultaneously with any of the strobes.

5. The non-addressable dual notification appliance of claim 1, further comprising at least one audible notification indicator.

6. The non-addressable dual notification appliance of claim 1, where the control signal and a power signal utilize a common line.

7. The non-addressable dual notification appliance of claim 1, each of the at least two visual notification indicators being associated with a distinct detected event.

8. An alarm system, comprising:

a plurality of non-addressable notification appliances, each non-addressable notification appliance including:

at least two visual notification indicators; and microcontroller and communications decoder configured to receive a control signal from a system controller, and which, responsive to a first received control signal having a first pattern, activates a first of the at least two visual notification indicators, and further which, responsive to a second received control signal having a second pattern distinct from the first pattern, activates a second of the at least two visual notification indicators; and wherein the microcontroller and communications decoder are housed within a same structural unit of the non-addressable dual notification appliance comprising the at least two visual notification indicators.

9. The alarm system of claim 8, wherein each of the at least two visual notification indicators is associated with a distinct detected event.

10. The alarm system of claim 8, wherein the at least two visual notification indicators are strobes.

11. The alarm system of claim 10, further comprising an audible notification device that is activated simultaneously with any of the strobes.

12. The alarm system of claim 8, each non-addressable notification appliance further including at least two audible notification indicators.

13. The alarm system of claim 8, where the control signal and a power signal utilize a common line.

14. The alarm system of claim 8, each of the at least two visual notification indicators being configured to provide a unique indication of a different detected event.

15. An alarm method, comprising:

receiving a control message from a system controller at a communications decoder operating with a microcontroller located within a non-addressable notification appliance, the control message corresponding to a detected event; and activating one of a plurality of visual notification indicators of the non-addressable notification appliance based on a type of the detected event, wherein responsive to a first type of detected event, a first one of the plurality of visual notification indicators is activated, and further which, responsive to a second type of detected event, a second of the plurality of visual notification indicators is activated; and wherein the microcontroller and communications decoder are housed within a same structural unit of the non-addressable dual notification appliance comprising the plurality of visual notification indicators.

16. The alarm method of claim 15, the communications decoder interpreting the control message to determine the type of the detected event, and providing a notification signal to a control unit to activate to a specific one of the plurality of visual notification indicators based on the type.

17. The alarm method of claim 15, the control message comprising a voltage drop.

18. The alarm method of claim 15, the plurality of visual notification indicators comprising a plurality of strobes.

19. The alarm method of claim 18, the plurality of strobes having different colors.

* * * * *